US006186605B1

(12) United States Patent
Nelson

(10) Patent No.: US 6,186,605 B1
(45) Date of Patent: Feb. 13, 2001

(54) COUNTERTOP AND BACKSPLASH INTEGRATION/ASSEMBLY

(75) Inventor: Thomas J. Nelson, Belton, TX (US)

(73) Assignee: Premark RWP Holdings, Inc., Wilmington, DE (US)

( * ) Notice: Under 35 U.S.C. 154(b), the term of this patent shall be extended for 0 days.

(21) Appl. No.: 09/353,397

(22) Filed: Jul. 15, 1999

(51) Int. Cl.[7] ..... A47B 96/18
(52) U.S. Cl. ..... 312/140.4; 52/287.1
(58) Field of Search ..... 312/140.4; 11/140.3, 11/140.1, 288.1, 250; 108/27; 52/287.1; 248/235

(56) References Cited

U.S. PATENT DOCUMENTS

| | | | | |
|---|---|---|---|---|
| 2,586,112 | * | 2/1952 | Stoddard | 312/140.3 X |
| 2,594,516 | * | 4/1952 | Swisher | 312/140.3 X |
| 2,785,937 | * | 3/1957 | Murray | 312/140.4 X |
| 3,007,213 | * | 11/1961 | Hobbs | 52/287.1 |
| 4,126,365 | * | 11/1978 | Bryant | 312/140.4 |
| 4,905,438 | * | 3/1990 | Brennan | 52/288.1 |
| 5,289,663 | * | 3/1994 | Schluter | 52/287.1 |
| 5,419,264 | * | 5/1995 | Davis | 312/140.1 X |
| 5,444,953 | * | 8/1995 | Koenig et al. | 52/288.1 X |
| 5,980,151 | * | 11/1999 | Manning | 108/27 X |

FOREIGN PATENT DOCUMENTS

| | | | | |
|---|---|---|---|---|
| 2615901 | * | 10/1977 | (DE) | 312/140.4 |
| 3712718 | * | 11/1988 | (DE) | 312/140.4 |
| 599821 | * | 11/1959 | (IT) | 312/140.4 |

* cited by examiner

*Primary Examiner*—Peter M. Cuomo
*Assistant Examiner*—Hank V. Tran
(74) *Attorney, Agent, or Firm*—Aquilino, Welsh & Flaxman

(57) ABSTRACT

An installation system for installing a backsplash and countertop upon a horizontal support member. The system includes an elongated mounting bracket shaped for selective attachment to a vertical support surface. The elongated mounting bracket includes a mounting bracket retaining member. The system further includes a countertop and a backsplash, wherein the rear surface of the backsplash includes a backsplash retaining member shaped for selective attachment to the mounting bracket retaining member. In use, the elongated mounting bracket is secured to the vertical support surface adjacent the horizontal support member, the countertop is placed upon the horizontal support member with its rear edge adjacent the support surface and the mounting bracket retaining member engages the backsplash retaining member to securely retain the countertop and backsplash relative to the elongated mounting bracket, the vertical support surface and the horizontal support member.

44 Claims, 6 Drawing Sheets

COUNTERTOP AND BACKSPLASH INTEGRATION/ASSEMBLY

BACKGROUND OF THE INVENTION

1. Field of the Invention

The invention relates to the installation of adjacent members upon a support member. More particularly, the invention relates to a system for installing countertops and backsplashes along a support surface.

2. Description of the Prior Art

The construction of many kitchens and bathrooms demands that the countertop and backsplash be formed as separate pieces. The countertop and backsplash are then separately installed within the consumer's kitchen or bathroom.

The components are commonly installed by first positioning the countertop on the cabinets, or other support structure, and screwing both the front and the back of the countertop into the cabinets. Specifically, the countertop is attached to the cabinet by reaching within the cabinet and screwing up into the underside of the countertop.

The process of accessing the underside of the countertop is generally cumbersome in view of the many shelves and accessories commonly found within kitchen and bath cabinets. In addition, there is always the concern that a screw will pass completely through the countertop, thereby destroying the countertop, or at a minimum necessitating substantial repair costs.

Once the countertop is properly secured, the backsplash is positioned and installed along the wall line. Backsplashes are commonly installed in one of two manners. First, and most commonly, the backsplash is simply glued to the support wall running adjacent the countertop. In addition to the inherent messiness associated with the use of glue, its use in the installation of a backsplash is accompanied by many shortcomings.

For example, the backsplash must be held in position while the glue sets. This is commonly not a problem when the walls of a home are square. However, as those skilled in the art will appreciate, the walls of most homes are far from square and various clamping techniques must be employed to ensure that the backsplash remains in position while the glue sets.

Backsplashes are also installed by screwing up and into the backsplash from the underside of the countertop. This technique is, however, difficult and provides results with many shortcomings. Specifically, the core of most backsplashes is fiberboard and does not provide an ideal material within which to retain a screw. The core is also relatively thin, and any deviations from the center of the core may result in damage to the backsplash.

Whether the backsplash is installed using glue, screws, or a combination of the two, it is almost impossible to complete installation without the need for caulking the various seams showing between the backsplash, countertop and wall. For example, where the cabinets are not fully level, the countertop will settle upon installation, creating a gap between the backsplash and the countertop. Where the wall is not square, the backsplash will not lay flush thereon, revealing a gap between the backsplash and the wall.

Assuming the countertop and backsplash are installed with all of the seams flush, homes and cabinets unfortunately settle over time. As the home or cabinet settles, seams between the backsplash and countertop open, revealing unsightly and aesthetically undesirable gaps. While these gaps may be filled with caulk, the caulk only partially hides the gaps, and provides a limited time fix.

With the foregoing in mind, a need exists for a system which facilitates the integrated assembly of countertops and backsplashes in a convenient, reliable and secure manner. The system must ensure the integrated assembly of countertops and backsplashes such that they form an ostensibly seamless assembly. The present invention provides such a system for facilitating the installation of countertops and backsplashes.

SUMMARY OF THE INVENTION

It is, therefore, an object of the present invention to provide an installation system for installing a backsplash and countertop upon a horizontal support member. The system includes an elongated mounting bracket shaped for selective attachment to a vertical support surface. The elongated mounting bracket includes a mounting bracket retaining member. The system further includes a countertop and a backsplash, wherein the rear surface of the backsplash includes a backsplash retaining member shaped for selective attachment to the mounting bracket retaining member. In use, the elongated mounting bracket is secured to the vertical support surface adjacent the horizontal support member, the countertop is placed upon the horizontal support member with its rear edge adjacent the support surface and the mounting bracket retaining member engages the backsplash retaining member to securely retain the countertop and backsplash relative to the elongated mounting bracket, the vertical support surface and the horizontal support member.

It is also an object of the present invention to provide an installation system for installing adjacent members upon a support member. The system includes an elongated mounting bracket shaped for selective attachment to a support surface. The elongated mounting bracket includes a mounting bracket connecting member and a mounting bracket retaining member. The system further includes a first member having a rear edge with a connecting member shaped to engage the mounting bracket connecting member as the first member is mounted upon the support surface and a second member having a rear surface with a retaining member shaped for attachment to the mounting bracket retaining member. In use, the elongated mounting bracket is secured to the support surface adjacent the support member, and the mounting bracket connecting member and the mounting bracket retaining member respectively engage the connecting member of the first member and the retaining member of the second member to securely retain the first member and the second member relative to the elongated mounting bracket, the support surface and the support member.

It is another object of the present invention to provide a method for the installation of a countertop and a backsplash. The method is accomplished by first securing a mounting bracket to a support surface adjacent a support member upon which the countertop is to sit, wherein the mounting bracket includes at least a mounting bracket retaining member. The countertop is then mounted upon the support member and the backsplash is mounted upon the mounting bracket adjacent the countertop, wherein the backsplash includes a rear surface having a backsplash retaining member shaped and dimensioned for selective attachment to the mounting bracket retaining member.

It is still a further object of the present invention to provide a mounting bracket adapted for the installation of adjacent members upon a support member, wherein a first member includes a top surface, a bottom surface, a front edge and a rear edge having a slot therein and the second member includes a facing surface, a top surface, a bottom surface and a rear surface having a retaining slot. The mounting bracket includes an elongated support member having a wall engaging surface and an outwardly facing surface. The wall engaging surface is substantially flat to lie flush against the wall. The outwardly facing surface includes a outwardly facing first member flange adapted for receipt within the slot of the first member, an outwardly facing retaining flange for receipt within the retaining slot of the second member. In use, the elongated support member is secured to a support surface, the outwardly facing first member flange is positioned within the slot of the first member and the outwardly facing retaining flange is positioned within the retaining slot of the second member, and the first member flange and the retaining flange are spaced a predefined distance to create a self locking assembly wherein the first member and the second member are coupled to the mounting bracket.

DESCRIPTION OF THE PREFERRED EMBODIMENT

Figure 1:
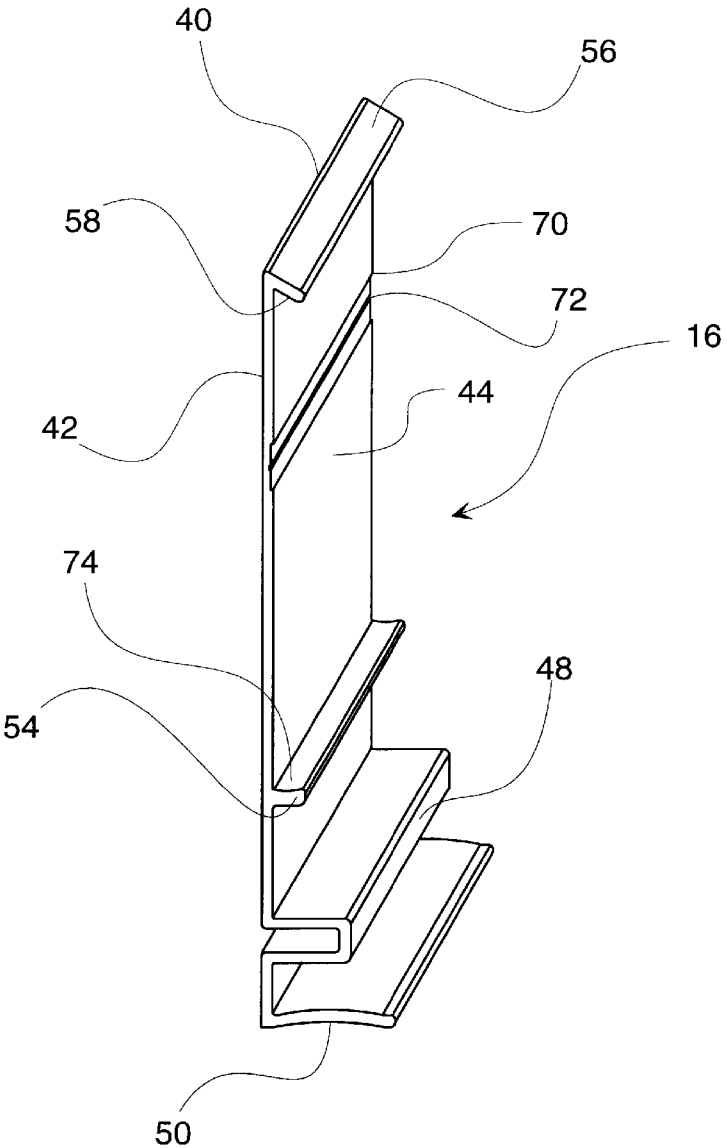
FIG. 1 is a perspective view of the mounting bracket in accordance with the present invention.
Figure 2:
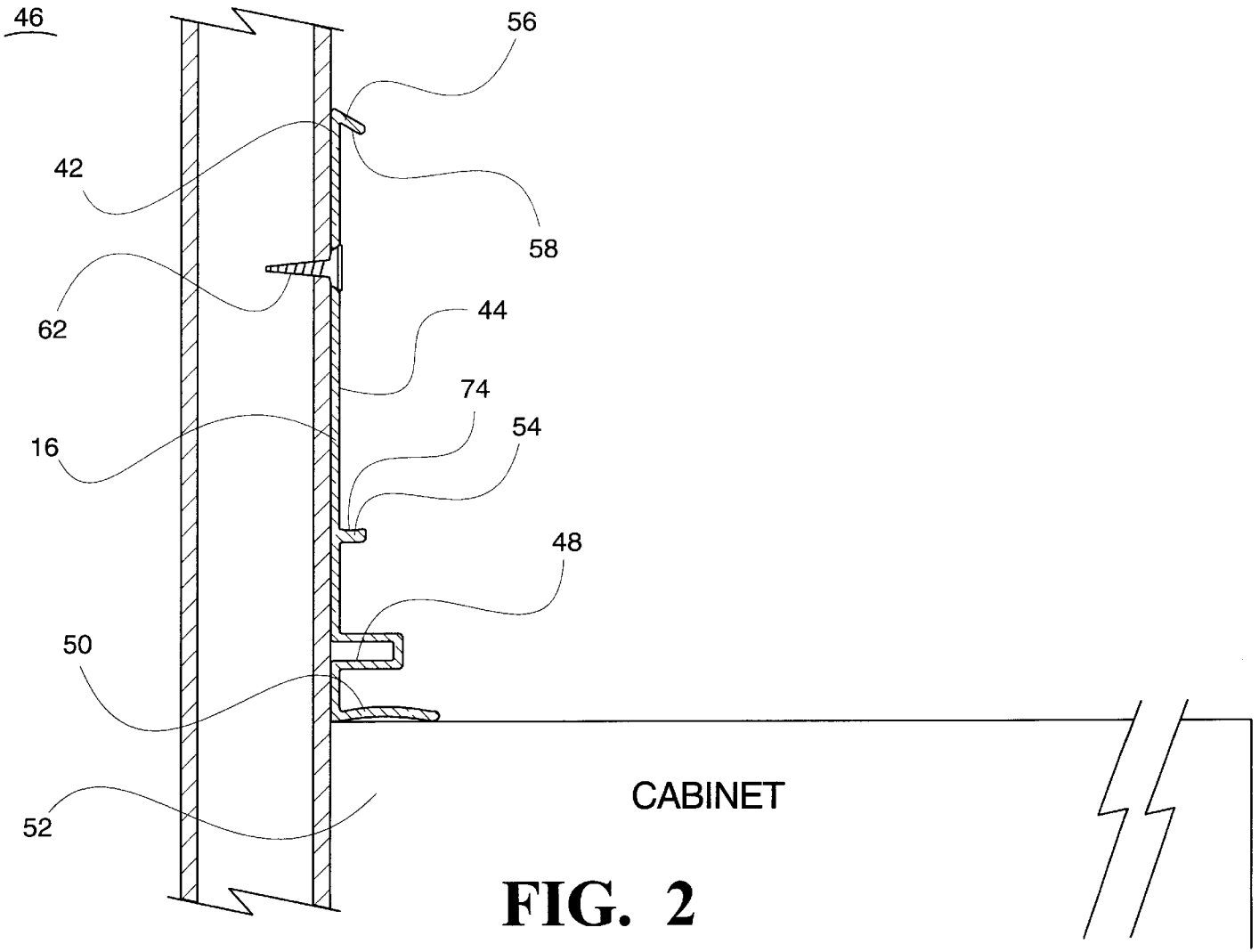
FIGS. 2–6 are a sequence of cross-sectional views showing the installation of a countertop and backsplash in accordance with the present invention.
Figure 3:
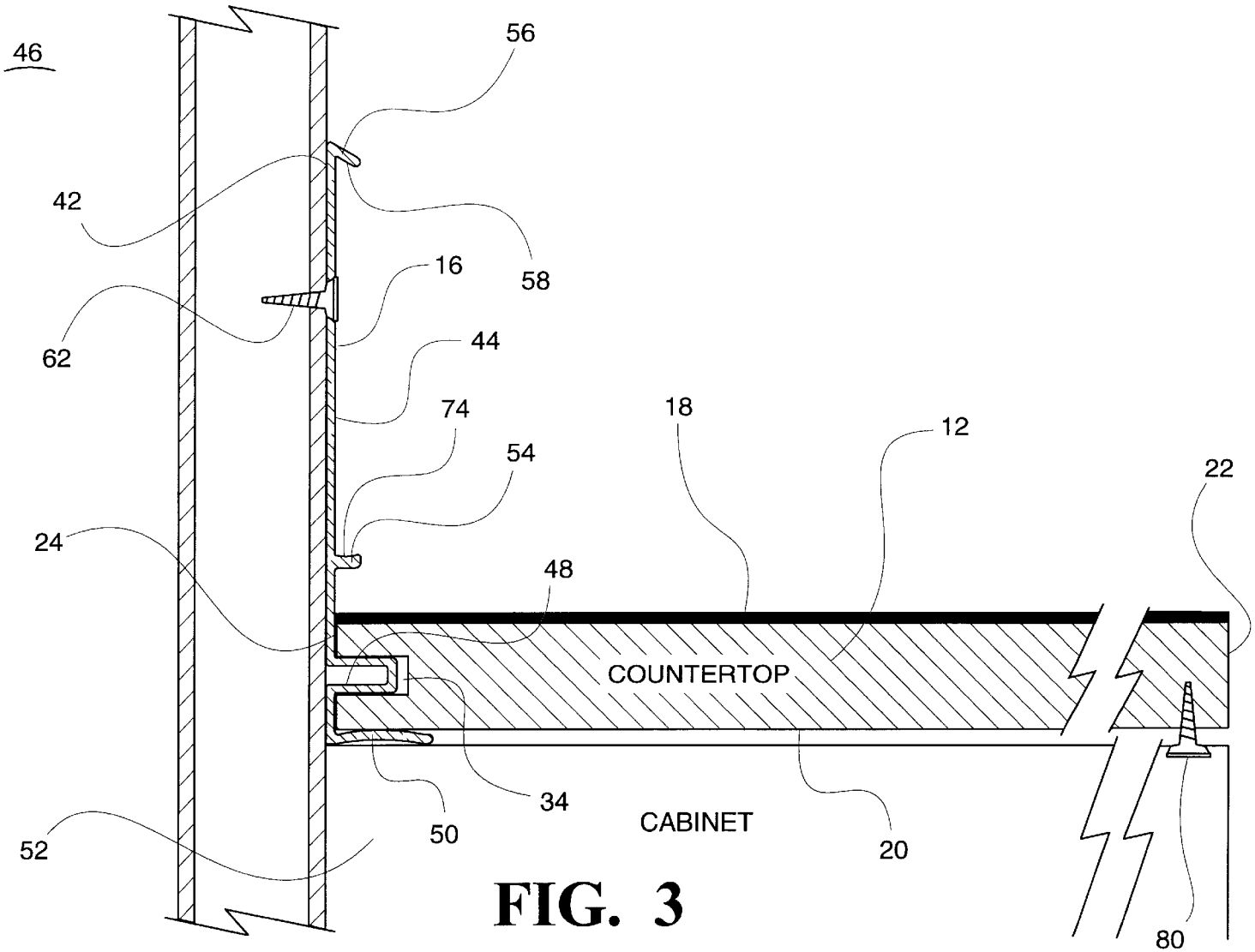
Figure 4:
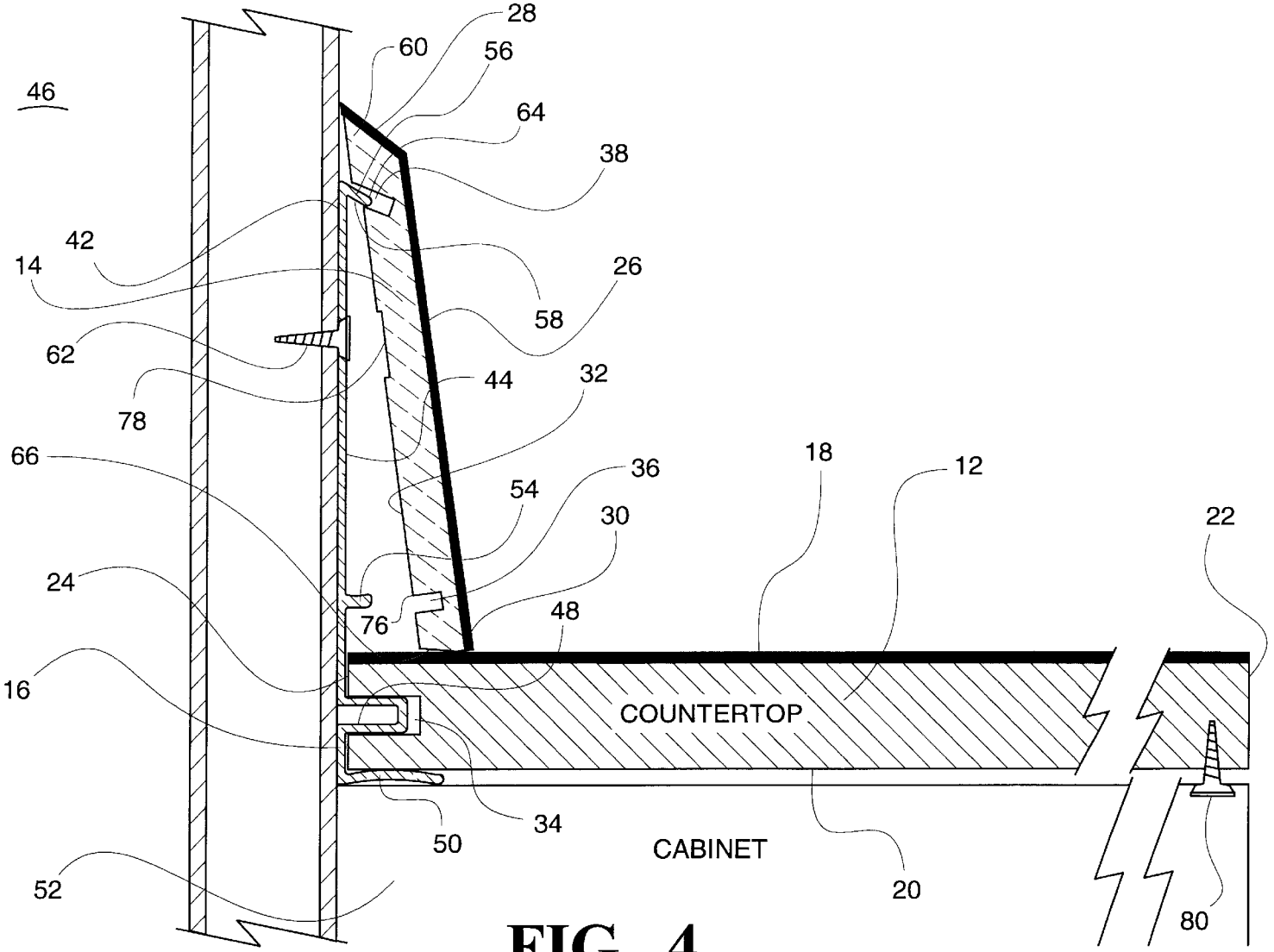
Figure 5:
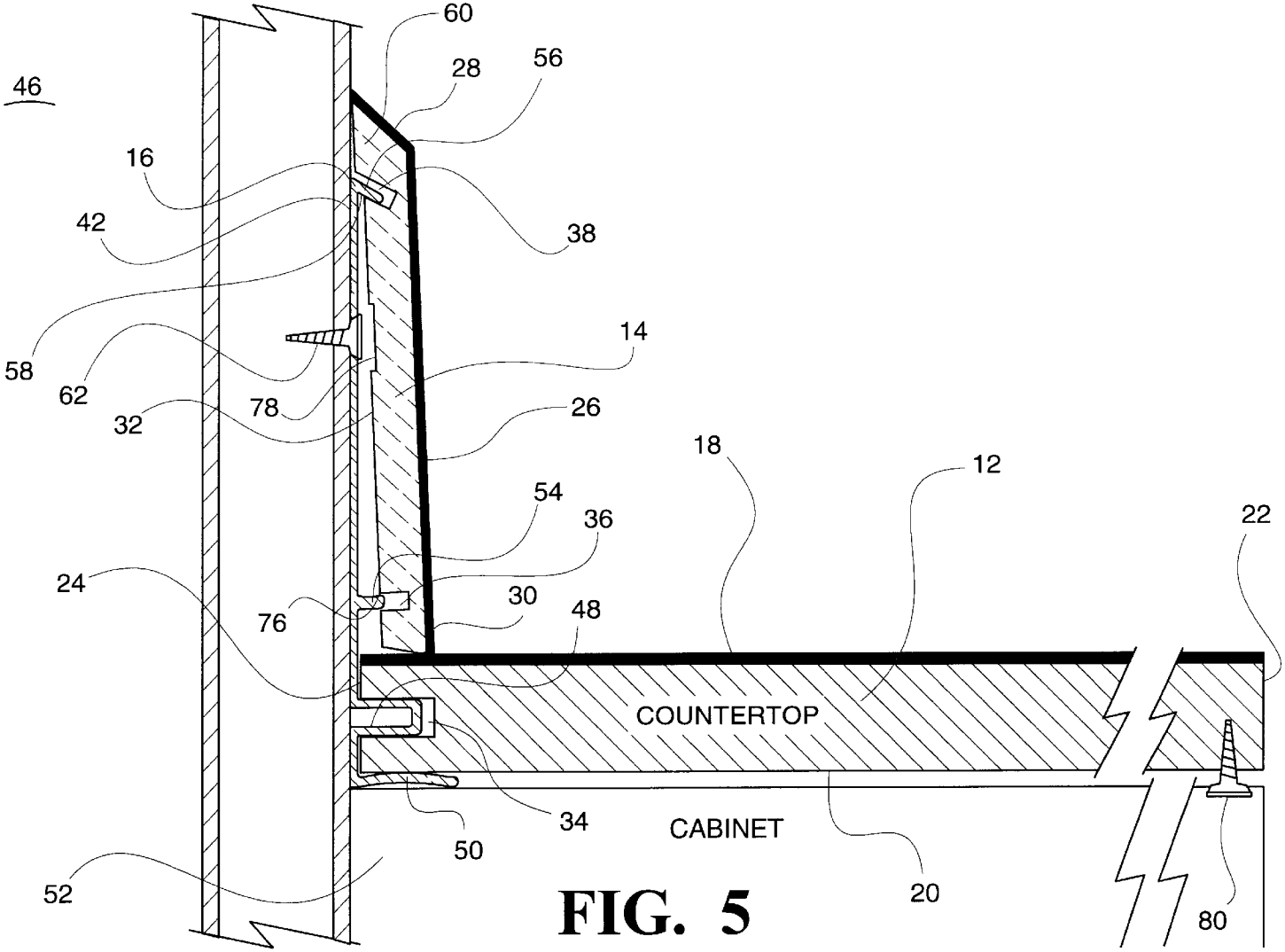
Figure 6:
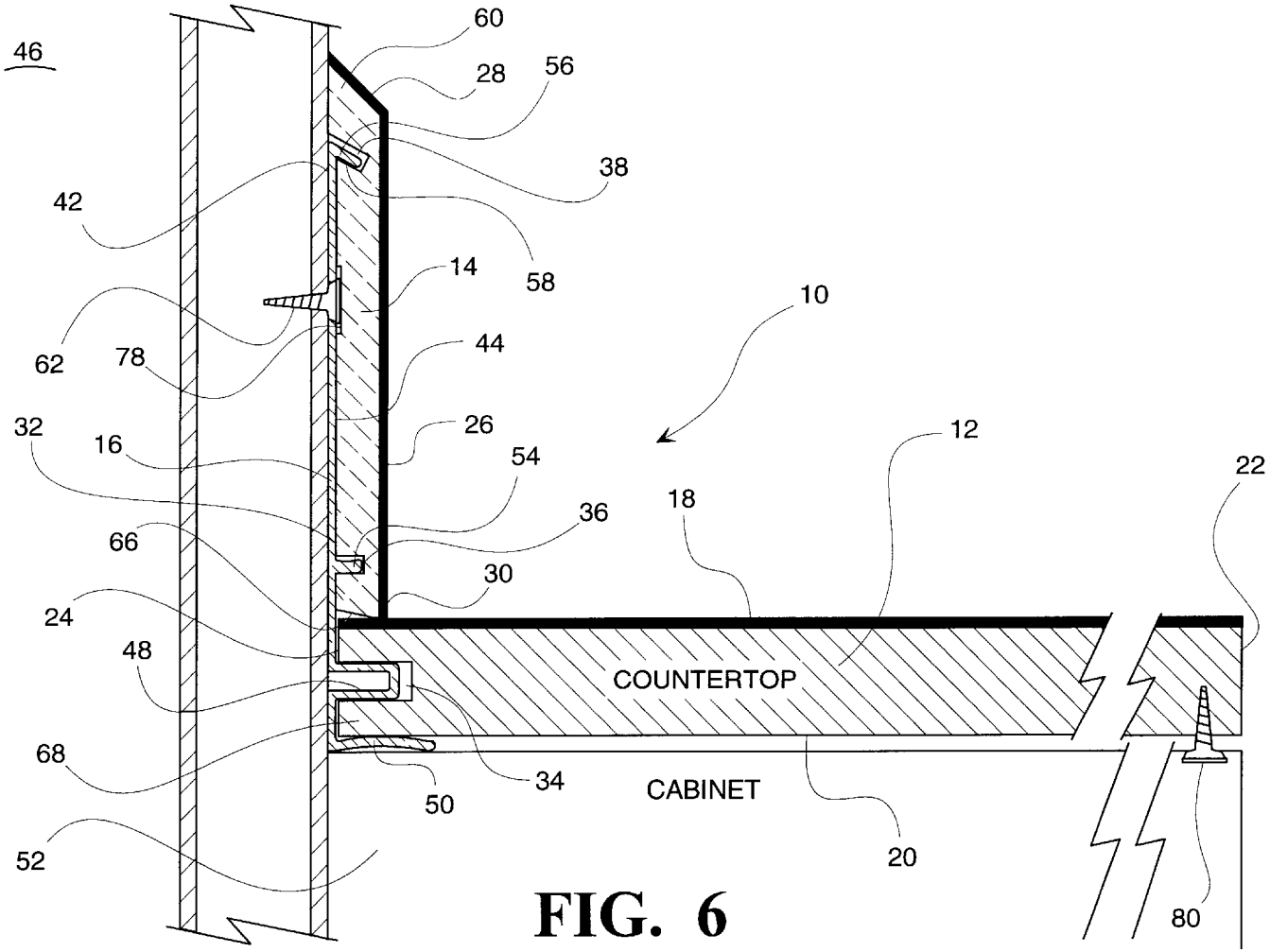

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1–6, a system 10 for the installation of a countertop 12 and backsplash 14 is disclosed. The system 10 includes an elongated mounting bracket 16 shaped and dimensioned to maintain the countertop 12 and backsplash 14 in an ideal spaced relationship, while also simplifying the installation of the countertop 12 and backsplash 14 within a kitchen, bathroom, or other location.

As with prior countertop assemblies, the countertop 12 includes a top surface 18, a bottom surface 20, a front edge 22 and a rear edge 24. The backsplash 14 includes a facing surface 26, a top surface 28, a bottom surface 30 and a rear surface 32. However, and in contrast to conventional countertop assemblies, the rear edge 24 of the countertop 12 includes a slot 34 therein and the rear surface 32 of the backsplash 14 includes an alignment slot 36 and a retaining slot 38. The countertop slot 34, alignment slot 36 and retaining slot 38 cooperate with the mounting bracket 16 to facilitate installation and maintenance of the countertop assembly in a manner which will be discussed in greater detail.

With the foregoing in mind, and with reference to FIG. 1, the mounting bracket 16 includes an elongated support member 40 having a wall engaging surface 42 and an outwardly facing surface 44. The mounting bracket 16 is preferably extruded from aluminum, although other materials and manufacturing techniques may be employed without departing from the spirit of the present invention.

The outwardly facing surface 44 is provided with a longitudinally extending recess 70 aligned with a longitudinal axis of the mounting bracket 16. The recess 70 provides space allowing the heads of the securing screws 62 (discussed in greater detail below) to lie substantially flush with the outwardly facing surface 44 of the mounting bracket 16. A longitudinal groove 72 is formed within the center of the recess 70. The groove 72 is designed to guide the tip of a screw 62 as it is fastened to the mounting bracket 16 in the manner discussed below.

The wall engaging surface 42 is substantially flat. It is shaped and dimensioned to lie flush against the wall 46. In fact, when the mounting bracket 16 is installed in accordance with the present invention, the mounting bracket 16 is sufficiently flexible to conform with inward and outward bows commonly found in older homes and developing in younger homes as they settle.

The ability of the mounting bracket 16 to flex in conformance with the wall 46 upon which it is mounted serves to maintain the countertop 12 and backsplash 14 in a desired orientation despite settling of a home or slight imperfections existing during installation of the countertop assembly. Specifically, and as will be discussed in greater detail below, the interaction between the countertop 12, backsplash 14 and mounting bracket 16 sustains the components in a desired spaced relationship despite settling of a home or slight imperfections existing during installation.

The outwardly facing surface 44 of the mounting bracket 16 includes an outwardly facing countertop flange 48 shaped and dimensioned for receipt within the countertop slot 34. The countertop flange 48 guides the countertop 12 to a predetermined position and maintains the countertop 12 in that predetermined position.

An outwardly extending resilient bowed arm 50 is positioned at the distal end of the mounting bracket 16 adjacent the countertop flange 48. The bowed arm 50 engages the bottom surface 20 of the countertop 12 adjacent the countertop slot 34 to support the countertop 12. The resilience and strength of the bowed arm 50 ensure support of the bottom surface 20 adjacent the rear edge 24 of the countertop 12 as the cabinets 52, or other support structure upon which the countertop assembly is mounted, settle over time. The bowed arm 50 provides a variety of other functions which will be discussed in the following disclosure.

The mounting bracket 16 further includes an outwardly facing backsplash alignment flange 54 shaped and dimensioned for receipt within the alignment slot 36 of the backsplash 14 and an outwardly facing backsplash retaining flange 56 shaped and dimensioned for receipt within the retaining slot 38 of the backsplash 14. As will be discussed in greater detail below, the alignment flange 54 helps to properly orient the backsplash 14 with respect to the countertop 12, while the angled nature of the retaining slot 38 and the retaining flange 56 work to lock the backsplash 14 in position adjacent the vertical wall surface 46. In addition, the alignment flange 54 pushes the backsplash 14 flush with the top surface 18 of the countertop 12, helping to lock the backsplash 14 in position relative to the countertop 12.

In accordance with the preferred embodiment of the present invention, the retaining flange 56 is set approximately at an angle 120° relative to the wall engaging surface 42. However, other angular orientations may be employed without departing from the spirit of the present invention. The retaining slot 38 is set at approximately the same angle.

Specifically, as the backsplash 14 is installed, and after the backsplash 14 is installed, the interaction between the retaining flange 56 and the retaining slot 38 draws the backsplash 14 toward the vertical support wall 46 upon which the mounting bracket 16 is secured. In fact, the upward pressure created as the countertop 12 pushes against the backsplash 14 urges the retaining slot 38 upwardly along the angled surface 58 provided by the retaining flange 56. In this way, the backsplash 14 is forced upwardly and rearwardly by the force of the countertop 12, and is, thereby, locked in position relative to the countertop 12. The upward force of the countertop 12 is ensured by the proper positioning of the backsplash slots 36, 38 and the countertop slot 34, as well as the resilient pressure supplied by the bowed arm 50 positioned beneath countertop 12.

By drawing the backsplash 14 upwardly and rearwardly as discussed above, the top surface 28 of the backsplash 14 is drawn flush with the wall. A flush assembly is ensured by including additional width to the upper segment 60 of the backsplash 14, for example, 1/16 inches (0.159 cm), to compensate for the width of the mounting bracket 16 positioned between the remainder of the backsplash 14 and the wall 46.

As briefly discussed above, the distances between the countertop flange 48, the backsplash alignment flange 54 and the backsplash retaining flange 56 are defined to ensure secure placement of the countertop 12 and backsplash 14. In accordance with the preferred embodiment of the present invention, the countertop flange 48 and backsplash alignment flange 54 are spaced a distance of 5/8 inches (1.587 cm), while the backsplash alignment flange 54 and the backsplash retaining flange 56 are spaced a distance of 3½ inches (8.89 cm). While a preferred embodiment is discussed above, the exact distances are ultimately defined by the dimensions of the countertop 12 and the backsplash 14. The exact dimensions may, therefore, be varied to suit various applications without departing from the spirit of the present invention.

The spacing between the countertop flange 48 and the bowed arm 50 is variable based upon the resilience of the bowed arm 50. In this way, the spacing between the countertop flange 48 and the bowed arm 50 is readily varied to accommodate variations in the overall thickness of the countertop 12. These variations are accommodated by specifically defining the distance between the top surface 18 of the countertop 12 and the countertop slot 34, while positioning any variations in the total thickness of the countertop 12 between the countertop slot 34 and the bottom surface 20 of the countertop 12. As such, any variations in the overall thickness of the countertop 12 will not adversely effect the critical positioning of the top surface 18 of the countertop 12 relative to the backsplash 14.

For example, if the preferred dimensions of the present invention dictate that the spacing between the top surface 18 of the countertop 12 and the countertop flange 34 be ¼ inch, the spacing between the top surface 18 of the countertop 12 and countertop slot 34 is always maintained at ¼ inch. Any variations in the overall thickness of the countertop 12 due to material choices, are passed on to the lower half of the countertop 12 below the countertop flange 34.

As discussed above, the mounting bracket 16 is secured to a vertical support surface, for example, a wall 46. With reference to FIGS. 2 to 6, the mounting bracket 16 is first positioned on the wall 46 adjacent cabinets 52, or other support member, upon which the countertop 12 is to sit. Prior to installation, the mounting bracket 16 is positioned to sit on the cabinet 52 upon which the countertop 12 is supported. Where variations in the upper surfaces of the cabinets 52 create spaces between the mounting bracket 16 and the cabinets 52, the mounting bracket 16 is installed such that the linear nature of the mounting bracket 16 is maintained.

Placement of the mounting bracket 16 above the cabinets 52 should not alter the functionality of the present invention, as the countertop flange 48 and the bowed arm 50 will provide any necessary support for the countertop 12 adjacent the rear edge 24 and wall 46. The mounting bracket 16 may also be installed above the cabinets 52 where specific applications dictate such positioning.

Once the orientation of the mounting bracket 16 is properly determined, self tapping screws 62 secure the mounting bracket 16 to the wall 46. The screws 62 are preferably installed at spaced intervals, for example, every 16 inches, such that they are set within available studs (not shown). As those skilled in the art will readily appreciate, other securing techniques may be employed without departing from the spirit of the present invention.

The countertop 12 is then placed upon the cabinets 52 and the rear edge 24 of the countertop 12 is pushed toward the wall 46 until the countertop flange 48 is received within the countertop slot 34. In this way, the countertop 12 is securely positioned relative to the mounting bracket 16 and the cabinets 52.

It is also contemplated that the countertop flange 48 of the mounting bracket 16 be placed within the countertop slot 34 before the countertop 12 is pushed back against the wall 46. In this way, the mounting bracket 16 is screwed into the wall 46 after it is pushed against the wall 46.

Once the countertop 12 is properly positioned, the front end of the countertop is screwed 80 into the cabinets 52, or other support structure, therebelow. The backsplash 14 is then mounted upon the mounting bracket 16 adjacent the rear edge 24 of the countertop 12. Specifically, and with reference to FIG. 4, the backsplash 14 is held at an angle such that the forward end 64 of the retaining flange 56 is received within the retaining slot 38.

At this point, the backsplash 14 is rotated until the bottom surface 30 of the backsplash 14 contacts the top surface 18 of the countertop 12. Continued rotation of the backsplash 14 toward the mounting bracket 16 and wall 46 forces the retaining flange 56 further within the retaining slot 38. Rotation of the backsplash 14 is continued against the resistance of the countertop 12. This resistance is the force which ultimately creates the pressure ensuring proper alignment of the backsplash 14 relative to the countertop 12.

Rotation of the backsplash 14 is facilitated by the placement of a tapered cant 66 along the bottom surface 30 of the backsplash 14. The cant 66 provides the clearance necessary to insert the backsplash retaining flange 56 within the backsplash retaining slot 38, and permits rotation of the backsplash 14 as discussed herein. In addition, the cant 66 provides a space for applying a small bead of sealant between the top surface 18 of the countertop 12 and the outwardly facing surface 44 of the mounting bracket 16 to prevent the penetration of water between the countertop 12 and the mounting bracket 16. Such penetration may occur when using a textured decorative surface that might permit water to seep between the top surface 18 of the countertop 12 and the bottom surface 30 of the backsplash 14.

Rotation is continued until the alignment flange 54 is fully received with the alignment slot 36. Movement of the alignment flange 54 within the alignment slot 36 is facilitated by providing the top surface 74 of the alignment flange 54 with a curved concave surface. The curved shape of the top surface 74 allows for rotation of the backsplash 14 onto the alignment flange 54 without the forward edge 76 of the alignment slot 36 engaging the top surface 74 of the alignment flange 54 and impeding the rotation of the backsplash 14 relative the mounting bracket 16.

At this point, the backsplash 14 should be oriented approximately perpendicular to the countertop 12. A flush installation is ensured by providing a screw head recess 78 along the rear surface 32 of the backsplash 14 to provide space for exposed heads of screws 62 used in mounting the bracket 16. In addition, the pressure required to rotate the backsplash 14 into position ensures that continued upward pressure will be applied by the countertop 12. As discussed above, the upward pressure supplied by the countertop 12 and the bowed arm 50 pushes the retaining slot 38 upwardly along the angled surface 58 provided by the retaining flange 56. In this way, the backsplash 14 is forced upwardly and rearwardly by the force of the countertop 12.

Once the backsplash 14 and countertop 12 are properly installed they will remain flush despite settling and imperfections. For example, if the cabinets 52 settle, the rear end 68 of the countertop 12 will not settle with them. The rear end 68 of the countertop 12 is supported by the mounting bracket 16 and, therefore, will not settle. This is in contrast to conventional countertop assemblies where the weight of the countertop causes it to settle and move away from the backsplash (which is commonly glued to the wall). Similarly, where the wall 46 is bowed, or bows upon settling, the mounting bracket 16 follows the wall 46 and draws the backsplash 14 toward the wall 46 to seat the backsplash 14 flush with the wall 46. Other similar movements are countered by the arrangement of the mounting bracket 16, backsplash 14, and countertop 12 such that the countertop 12 and backsplash 14 are maintained in a proper orientation.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A countertop and backsplash assembly system for installing a backsplash and countertop upon a horizontal support member, comprising:

an elongated mounting bracket shaped for selective attachment to a vertical support surface, the elongated mounting bracket includes a mounting bracket retaining member which is an outwardly facing flange;

a countertop including a top surface, a bottom surface, a front edge and a rear edge;

a backsplash including a facing surface, a top surface, a bottom surface and a rear surface, the rear surface including a backsplash retaining member shaped for selective attachment to the mounting bracket retaining member; and the mounting bracket further includes an outwardly extending arm of a length and strength sufficient to support the countertop by engaging and supporting the bottom surface of the countertop;

wherein the elongated mounting bracket is secured to the vertical support surface adjacent the horizontal support member, the countertop is placed upon the horizontal support member with its rear edge supported on the outwardly extending arm adjacent the support surface and the mounting bracket retaining member engages the backsplash retaining member to securely retain the countertop and backsplash relative to the elongated mounting bracket, the vertical support surface and the horizontal support member.

2. The countertop and backsplash assembly system according to claim 1, wherein the backsplash retaining member is a slot formed in the rear surface of the backsplash and the retaining flange includes an oblique surface acting upon the slot of the backsplash to draw the backsplash toward the mounting bracket.

3. The countertop and backsplash assembly system according to claim 2, wherein the slot of the backsplash includes an oblique surface substantially conforming to the oblique surface of the retaining flange.

4. The countertop and backsplash assembly system according to claim 3, wherein the oblique surface is oriented at approximately a 120° angle relative to a longitudinal axis of the mounting bracket.

5. The countertop and backsplash assembly system according to claim 2, wherein the oblique surface is oriented at approximately a 120° angle relative to a longitudinal axis of the mounting bracket.

6. The countertop and backsplash assembly system according to claim 1, wherein the backsplash further includes a backsplash alignment member shaped and dimensioned to engage a mounting bracket alignment member formed in the mounting bracket.

7. The countertop and backsplash assembly system according to claim 1, wherein the outwardly extending arm is a bowed arm which supports the bottom surface of the countertop.

8. The countertop and backsplash assembly system according to claim 7, wherein the mounting bracket includes a first end and a second end, and the bowed arm is secured to the second end of the mounting bracket.

9. The countertop and backsplash assembly system according to claim 8, wherein the mounting bracket retaining member is adjacent a top end of the mounting bracket.

10. The countertop and backsplash assembly system according to claim 1, wherein the mounting bracket further includes a mounting bracket connecting member, and the rear edge of the countertop includes a countertop connecting member shaped to engage the mounting bracket connecting member as the countertop is mounted upon the horizontal support member.

11. An assembly system for installing adjacent members upon a support member, comprising:

an elongated mounting bracket shaped for selective attachment to a support surface, the elongated mounting bracket includes a mounting bracket connecting member and a mounting bracket retaining member, the mounting bracket retaining member being outwardly facing flange;

a first member including a top surface, a bottom surface, a front edge and a rear edge, the rear edge including a connecting member shaped to engage the mounting bracket connecting member as the first member is mounted upon the support surface; and a second member including a facing surface, a top surface, a bottom surface and a rear surface, the rear surface including a retaining member shaped for attachment to the mounting bracket retaining member; and the mounting bracket further includes an outwardly extending arm of a length and strength sufficient to support the first member by engaging and supporting the bottom surface of the first member;

wherein the elongated mounting bracket is secured to the support surface adjacent the support member, the first member is supported on the outwardly extending arm, and the mounting bracket connecting member and the mounting bracket retaining member respectively engage the connecting member of the first member and the retaining member of the second member to securely retain the first member and the second member relative to the elongated mounting bracket, the support surface and the support member.

12. The assembly system according to claim 11, wherein the first member is a countertop and the second member is a backsplash.

13. The assembly system according to claim 12, wherein the retaining member of the backsplash is a slot formed in the rear surface of the backsplash and the retaining flange includes an oblique surface acting upon the slot of the backsplash to draw the backsplash toward the mounting bracket.

14. The assembly system according to claim 13, wherein the slot of the backsplash includes an oblique surface substantially conforming to the oblique surface of the retaining flange.

15. The assembly system according to claim 14, wherein the oblique surface is oriented at approximately a 120° angle relative to a longitudinal axis of the mounting bracket.

16. The assembly system according to claim 13, wherein the oblique surface is oriented at approximately a 120° angle relative to a longitudinal axis of the mounting bracket.

17. The assembly system according to claim 12, wherein the backsplash further includes an alignment member shaped and dimensioned to engage a mounting bracket alignment member formed in the mounting bracket.

18. The assembly system according to claim 12, wherein the outwardly extending arm is a bowed arm which supports the bottom surface of the countertop.

19. The assembly system according to claim 18, wherein the mounting bracket includes a first end and a second end, and the bowed arm is secured to the second end of the mounting bracket.

20. The assembly system according to claim 19, wherein the mounting bracket retaining member is adjacent a top end of the mounting bracket.

21. The assembly system according to claim 11, wherein the retaining member of the second member is a slot formed in the rear surface of the second member and the retaining flange includes an oblique surface acting upon the slot of the second member to draw the second member toward the mounting bracket.

22. The assembly system according to claim 21, wherein the slot of the second member includes an oblique surface substantially conforming to the oblique surface of the retaining flange.

23. The assembly system according to claim 22, wherein the oblique surface is oriented at approximately a 120° angle relative to a longitudinal axis of the mounting bracket.

24. The assembly system according to claim 21, wherein the oblique surface is oriented at approximately a 120° angle relative to a longitudinal axis of the mounting bracket.

25. The assembly system according to claim 11, wherein the second member further includes an alignment slot shaped and dimensioned to receive an outwardly extending alignment flange formed in the mounting bracket.

26. The assembly system according to claim 11, wherein the outwardly extending arm is a bowed arm which supports the bottom surface of the first member.

27. The assembly system according to claim 26, wherein the mounting bracket includes a first end and a second end, and the bowed arm is secured to the second end of the mounting bracket.

28. A method for the installation of a countertop and a backsplash, comprising the following steps:

securing a mounting bracket to a vertical support surface adjacent a support member upon which the countertop is to sit, the mounting bracket including at least a mounting bracket retaining member which is an outwardly facing backsplash flange;

mounting a countertop upon the support member, wherein the countertop includes a top surface, a bottom surface, a front edge and a rear edge, the mounting bracket further including an outwardly extending arm of a length and strength sufficient to support the countertop, and wherein the step of mounting includes supporting the countertop upon the outwardly extending arm;

mounting a backsplash upon the mounting bracket and adjacent the countertop, wherein the backsplash includes a facing surface, a top surface, a bottom surface and a rear surface, the rear surface including a backsplash retaining member shaped and dimensioned for selective attachment to the mounting bracket retaining member.

29. The method according to claim 28, wherein the mounting bracket includes an outwardly facing countertop flange and the rear edge of the countertop includes a slot shaped and dimensioned to receive the countertop flange, and the step of mounting the countertop includes coupling the countertop to the mounting bracket by positioning the countertop flange with the slot.

30. The method according to claim 29, wherein the step of mounting the countertop includes pushing the countertop toward the mounting bracket until the countertop flange is fully seated within the slot in the rear edge of the countertop.

31. The method according to claim 30, wherein the step of mounting includes the further step of screwing a front end of the countertop adjacent the front edge of the countertop into the support member.

32. The method according to claim 28, wherein the backsplash retaining member is a retaining slot in the rear surface of the backsplash shaped and dimensioned to receive the outwardly facing backsplash flange, and the step of mounting a backsplash includes inserting the outwardly facing backsplash flange within the retaining slot of the backsplash.

33. The method according to claim 32, wherein the step of mounting the backsplash includes inserting the backsplash flange into the slot within the rear surface of the backsplash and rotating the backsplash until the rear surface of the backsplash is flush with the mounting bracket.

34. The method according to claim 33, wherein the backsplash flange includes an oblique surface acting upon the slot of the backsplash to draw the backsplash toward the mounting bracket.

35. The method according to claim 34, wherein the slot of the backsplash includes an oblique surface substantially conforming to the oblique surface of the retaining flange.

36. The method according to claim 35, wherein the oblique surface is oriented at approximately a 120° angle relative to a longitudinal axis of the mounting bracket.

37. The method according to claim 33, wherein the oblique surface is oriented at approximately a 120° angle relative to a longitudinal axis of the mounting bracket.

38. The method according to claim 28, wherein the mounting bracket further includes an outwardly extending alignment flange and the rear surface of the backsplash includes an alignment slot, and wherein the backsplash is rotated until the rear surface of the backsplash is flush with the mounting bracket and the alignment flange is fully seated within the alignment slot.

39. A mounting bracket adapted for the installation of adjacent members upon a support member, wherein a first member includes a top surface, a bottom surface, a front edge and a rear edge having a slot therein and the second member includes a facing surface, a top surface, a bottom surface and a rear surface having a retaining slot, the mounting bracket comprising:

an elongated support member including a wall engaging surface and an outwardly facing surface;

the wall engaging surface being substantially flat to lie flush against the wall;

the outwardly facing surface including an outwardly facing first member flange adapted for receipt within the slot of the first member, an outwardly facing retaining flange for receipt within the retaining slot of the second member, and an outwardly extending arm of a length and strength sufficient to support the bottom surface of the first member; and wherein the elongated support member is secured to a support surface, the bottom surface of the first member seated on the outwardly extending arm to support the first member, the outwardly facing first member flange is positioned within the slot of the first member and the outwardly facing retaining flange is positioned within the retaining slot of the second member, and the first member flange and the retaining flange are spaced a predefined distance to create a self locking assembly wherein the first member and the second member are coupled to the mounting bracket.

40. The mounting bracket according to claim 39, wherein the retaining flange includes an oblique surface acting upon the retaining slot of the second member to draw the second member toward the mounting bracket.

41. The mounting bracket according to claim 40, wherein the oblique surface is oriented at approximately a 120° angle relative to a longitudinal axis of the mounting bracket.

42. The mounting bracket according to claim 41, wherein the outwardly extending arm is a resilient bowed arm which supports the bottom surface of the first member.

43. The mounting bracket according to claim 42, wherein the mounting bracket includes a first end and a second end, and the bowed arm is secured to the second end of the mounting bracket.

44. The mounting bracket according to claim 43, wherein the retaining flange extends from a top end of the mounting bracket.

* * * * *